US005915497A

United States Patent [19]

Krause

[11] Patent Number: 5,915,497

[45] Date of Patent: Jun. 29, 1999

[54] WORKING PLATFORM

[75] Inventor: Günther Krause, Alsfeld, Germany

[73] Assignee: Krause-Werk GmbH & Co. KG, Alsfeld-Altenburg, Germany

[21] Appl. No.: 08/836,729

[22] PCT Filed: Aug. 16, 1995

[86] PCT No.: PCT/EP95/03251

§ 371 Date: Jul. 28, 1997

§ 102(e) Date: Jul. 28, 1997

[87] PCT Pub. No.: WO96/15341

PCT Pub. Date: May 23, 1996

[30] Foreign Application Priority Data

Nov. 11, 1994 [DE] Germany ..... 94 18 062 U

[51] Int. Cl.[6] ..... E04G 1/15

[52] U.S. Cl. ..... 182/119; 182/222

[58] Field of Search ..... 182/119, 222, 182/178.1, 179.1, 223

[56] References Cited

U.S. PATENT DOCUMENTS

| | | |
|---|---|---|
| 3,565,212 | 2/1971 | Johnson . |
| 4,331,218 | 5/1982 | Layher . |
| 4,496,029 | 1/1985 | Kuroda . |
| 4,811,530 | 3/1989 | Eyerly . |
| 5,152,371 | 10/1992 | Wyse . |

FOREIGN PATENT DOCUMENTS

| | | | |
|---|---|---|---|
| 276 489 | 8/1988 | European Pat. Off. . | |
| 300 399 | 1/1989 | European Pat. Off. . | |
| 0 305 014 | 3/1989 | European Pat. Off. . | |
| 305 014 | 3/1989 | European Pat. Off. . | |
| 332 061 | 9/1989 | European Pat. Off. . | |
| 451 616 A1 | 10/1991 | European Pat. Off. . | |
| 1 435 114 | 3/1966 | France . | |
| 2 083 431 | 12/1971 | France . | |
| 2 527 251 | 11/1983 | France . | |
| 2 582 702 | 12/1986 | France . | |
| 2582702 | 12/1986 | France | 182/222 |
| 8502756 U | 7/1986 | Germany . | |
| 4311788 | 10/1994 | Germany | 182/222 |
| 4412072 | 10/1994 | Germany | 182/113 |
| 586 335 | 3/1977 | Switzerland . | |
| 1026531 | 4/1966 | United Kingdom | 182/222 |
| 2 032 504 | 5/1980 | United Kingdom . | |

OTHER PUBLICATIONS

Drawings from U.S. application No. 08/765 831, filed Dec. 30, 1996 Atty Ref: Missling Case 302 (5 sheets).

Drawings from U.S. application No. 08/776 213, filed Mar. 20, 1997 Atty Ref: Missling Case 295 (3 sheets).

Drawings from U.S. application No. 08/776 205, filed Apr. 3, 1997 Atty Ref: Missling Case 303 (5 sheets).

*Primary Examiner*—Alvin Chin-Shue

*Attorney, Agent, or Firm*—Flynn, Thiel, Boutell & Tanis, P.C.

[57] ABSTRACT

Working platforms for scaffolding must be light and functional and easily stackable. It must therefore be possible to include all their components with a long useful life in the static calculations as well. The requirements include both great rigidity in the corner joint of a rectangular bearing frame for the working platform and the smallest possible gaps between adjacent platforms. Above all, however, the smallest possible number of components must be used to keep the costs of such a working platform within limits. To this end the invention makes use of a U-shaped folded footplate (2) clamped between the longitudinal bearing members (11) of the bearing frame. If, in addition, at least the longitudinal bearing members (11) are rectangular hollow sections, no dirt or residual building material can enter the working platform.

13 Claims, 4 Drawing Sheets

WORKING PLATFORM

FIELD OF THE INVENTION

The invention relates to a working platform for a scaffolding or the like, which can be fastened on two horizontal transverse spars of the scaffolding, consisting of at least one rectangular bearing frame composed of longitudinal bearing members and cross-bearing members, the ends of the bearing frame are formed by the cross-bearing members and are parallel with adjacent ends of further bearing frames provided at the same height on the scaffolding, and consisting of a bearing surface positioned on the bearing frame, preferably designed as a perforated plate.

BACKGROUND OF THE INVENTION

In conventional working platforms, the respective bearing frame is equipped with a plate-shaped cover, which generally consists of a laminated plywood and is riveted to the bearing frame. The numerous perforations in the plywood, during the use of the working platform, results in time in an enlargement of the rivet bores in the plywood so that the cover is unable to contribute to the stiffness of the working platform and is not given consideration during its static performance calculation. The shifting of the cover on the bearing frame, even if only slightly increasing, contributes moreover to a reduction in the workman's stepping safety during the use of the working platform.

It has therefore also already been suggested that the plywood sheets be bounded by a metallic holding frame resting on the flanges of the bearing frame, in particular when the cover at its holding frame is thereby riveted to the bearing frame by means of connecting elements. The holding frame is less subject to permanent deformation in the bores for the connecting elements than the plywood sheets so that looseness due to wear in the area of these connecting elements can indeed be avoided even in the case of high stress on the working platform. However, such a working platform is expensive.

Instead it has been also known for a long time to design the bearing surface with simple steel floors of perforated plates, which are bent at their longitudinal sides to form short, vertical crosspiece strips fastened to the bearing frames resting on the same. In order to achieve a sufficient resistance force to rotational movement, these edging crosspiece strips are bent at least one more time, and as a rule several times to the inside so that the bearing surface is defined on both sides by a U-shaped to a box-shaped, more or less solid, at all positions, however, an open hollow cross section. The manufacture of such bent footplates from bending blanks is personnel and cost intensive, and the footplates are, because of the not closed and non-closeable hollow sections, not as torsional-resistant as desired. Furthermore, it cannot be avoided during operation of the work platform that dirt and building rubble penetrates through the perforated plate into the hollow cross sections and can only be removed with great difficulty and effort.

It is also known that at least the longitudinal bearing members consist of a preferably extruded hollow section, which is approximately rectangular in cross section and each of which is composed of two parallel vertical crosspieces and two horizontal flanges. Such a box-shaped design of the longitudinal bearing members results in a torsion-free design of the bearing frame, in particular, when at the corner joints of the bearing frame the crosspieces of the cross-bearing members are each carried through to the outer crosspiece of the longitudinal bearing members and are welded to the flanges and/or crosspieces of the longitudinal bearing members. Such a corner joint has in this manner a very robust design and can be highly stressed. Furthermore, this type of design has the advantage that the ends of the bearing frame already at its longitudinal sides form closed surfaces.

The purpose of the invention is to design a working platform of the general type identified in detail above to be very reliable in operation using simple means, and, moreover, in such a manner that the bearing surface permanently improves the stiffness of the working platform and can be included in the static performance calculations. Moreover, it is intended to be easy to manufacture and to be easily connectable to the bearing frame. At the same time care is taken to safely prevent an accumulation of dirt and building rubble in the working platform. Furthermore, an arrangement is possible such that several working platforms are reciprocally sufficiently locked when they are stored stacked one on top of the other.

SUMMARY OF THE INVENTION

The purpose is attained according to the invention in such a manner that at least the longitudinal bearing members each have of a closed hollow section, which is approximately rectangular in cross section, and each of which is composed of two parallel vertical crosspieces and horizontal flanges. Furthermore, a footplate, on which a worker can walk and which has the bearing surface, is clamped between the longitudinal bearing members. The footplate is fastened directly to the longitudinal bearing members. The footplate has U-shaped design and its upper horizontal crosspiece plate is used as the bearing surface, and vertical flange plates, which on both sides of the crosspiece plate are bent approximately at a right angle downwardly, are fastened on the inner crosspieces of the longitudinal bearing members.

The connecting of a bearing frame, which is formed at least partially out of closed hollow sections, to a footplate, which is bent at both sides each at a right angle and which does not require any further cover member, results in an extraordinarily torsion-resistant construction, however, which is constructed with little expense and can yet be designed very light.

It is advantageous when the footplate is designed at least partially as a perforated plate. Even though it cannot be avoided at a building site that dirt and construction particles fall through the perforated plate, they cannot accumulate in the footplate but instead continue to fall therethrough. The working platform thus remains clean.

The working platform is prepared to be easily stackable when the flange plates are fastened to the longitudinal bearing members in such a manner that the crosspiece plate is arranged surface-parallel offset above the upper flanges of the longitudinal bearing members. It is particularly advantageous when the crosspiece plate projects approximately at half the width of the flange plates above the upper flanges of the bearing frame.

The working platform is designed extraordinarily torsion-resistant when the flange plates are welded to the inner crosspieces of the longitudinal bearing members, for example through a series of resistance spot welds. The cross-bearing members, which are welded to the longitudinal bearing members on the ends of the bearing frame, can thereby be designed as standing U-shaped bent sections, whereby the vertical sectional crosspiece of the respective cross-bearing member borders the bearing frame on the end and the sectional flanges can be positioned such that the sectional crosspiece at the same time covers the hollow section of the respective longitudinal bearing member closing the same. The entire surface of the end of the bearing frame is in this manner available, for example for fastening of connecting elements, and the hollow section of the longitudinal bearing members is also closed off on the ends.

It is advantageous when the upper sectional flanges underpin the footplate so that the same is supported also on the ends of the bearing frame in such a manner that bending is avoided.

Furthermore according to the invention, if the lower sectional flanges end above the lower flanges of the longitudinal bearing members, the footplates and thus the entire working platform are then, when several working platforms are stacked, safely oriented within the respective next higher stacked working platform at least in the direction transverse with respect to the longitudinal extent of the working platforms, which direction is important for a safe stacking. Such an arrangement results automatically when the cross-bearing members have the same bearing-frame uniform height as the longitudinal bearing members; thus the projection above the longitudinal bearing members is at the top just as high as the insertion at the bottom above the longitudinal bearing member lower edge.

The working platform can be fastened in a simple manner to the scaffolding when at least two hook-shaped mountings, which are fastened to the cross-bearing members and are received on the transverse spars of the scaffolding, are provided on each end of the bearing frame. Adjacent working platforms can thereby be supported with their ends closely resting next to one another on the same transverse spar when the mountings on the cross-bearing members of the bearing frame are arranged in the direction parallel to the ends and are spaced from the longitudinal sides of the bearing frame, which longitudinal sides are formed by the longitudinal bearing members, in such a manner that they are offset with respect to the mountings on the adjacent cross-bearing members of a further similar bearing frame so that with the bearing frames being aligned the mountings can be arranged on the same transverse spar. It is thereby advantageous when the mountings are provided in pairs on the cross-bearing members and in the vicinity of the longitudinal bearing members so that the stress on the working platform is transferred as evenly distributed as possible onto the scaffolding. The mountings can be welded in a simple and effective manner to the cross-bearing members of the bearing frame.

If the working platform designed according to the invention is a particularly long extended part, it may be advantageous for the stiffness of the working platform when at least one reinforcing bar is clamped between the longitudinal bearing members on the bearing frame parallel to the cross-bearing members, advantageously approximately in the center between the cross-bearing members which are on both ends.

The invention reduces the building components needed for a working platform to very few in number, simply designed and therefore also inexpensively manufacturable building elements, which, however, as a whole with a light-weight construction throughout permit a very inherently stable and highly stressable working platform.

BRIEF DESCRIPTION OF THE DRAWINGS

The invention will be discussed in greater detail hereinafter in connection with one exemplary embodiment and the drawings, in which.

Figure 2:
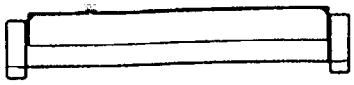
FIG. 2 is a front view in the cross section along B—B of FIG. 1, in which the working platform is illustrated in its position of use.

The same component parts on an adjacent working platform are indicated with reference numerals primed, however, are not shown in the drawings.

Figure 1:
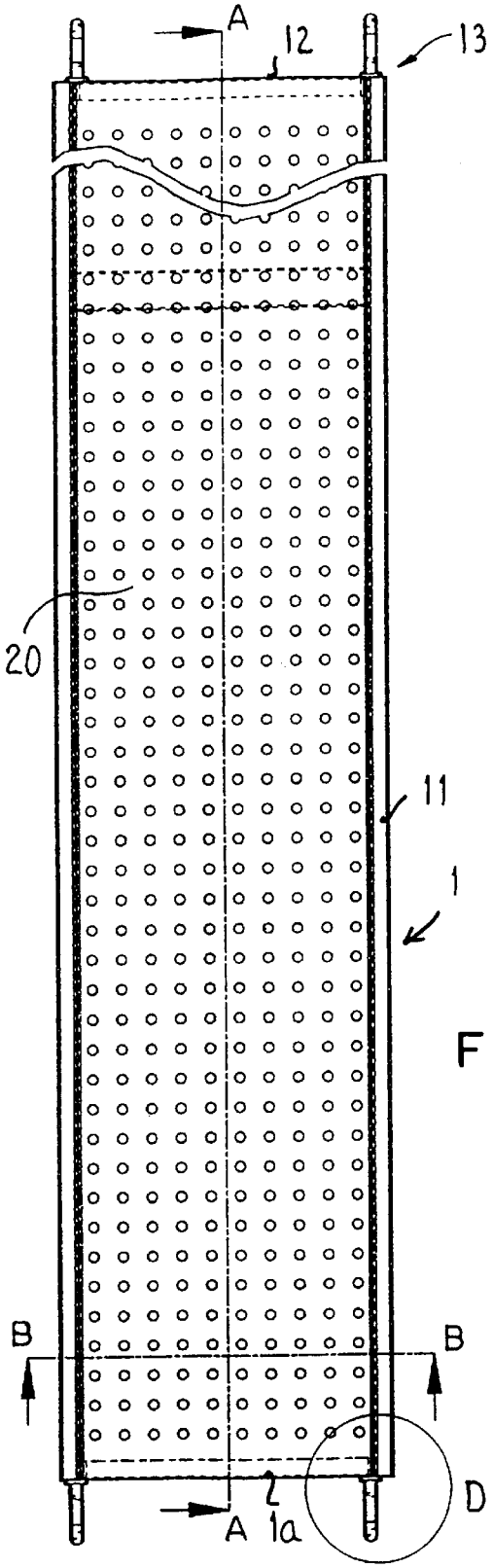
FIG. 1 is a top view of the working platform of the invention.
Figure 3:
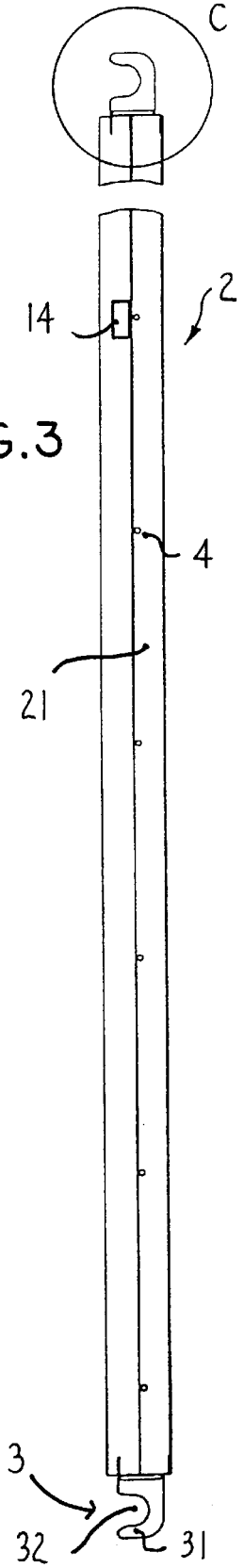
FIG. 3 is a cross sectional view along A—A of FIG. 1.

A working platform according to the invention consists, corresponding to FIGS. 1 to 3, essentially of a bearing frame 1, a footplate 2 and hook-shaped mountings 3.

The bearing frame 1 is composed of two longitudinal bearing members 11 and two cross-bearing members 12, which are welded together at the corners 13 of the bearing frame 1. A reinforcing bar 14 is clamped between the longitudinal bearing members 11 approximately centered between the cross-bearing members 12 and is connected therebetween with its own material or also by welding seams. The cross-bearing members 12 form surfaces on the bearing frame 1, which surfaces are closed on the end of the frame and to which the mountings 3 are welded in such a manner that the hook 31 provided thereon opens downwardly in the position of use so that the hook eyelets 32 of each end 1*a* of the bearing frame can cover a transverse spar of the scaffolding.

Figure 6:
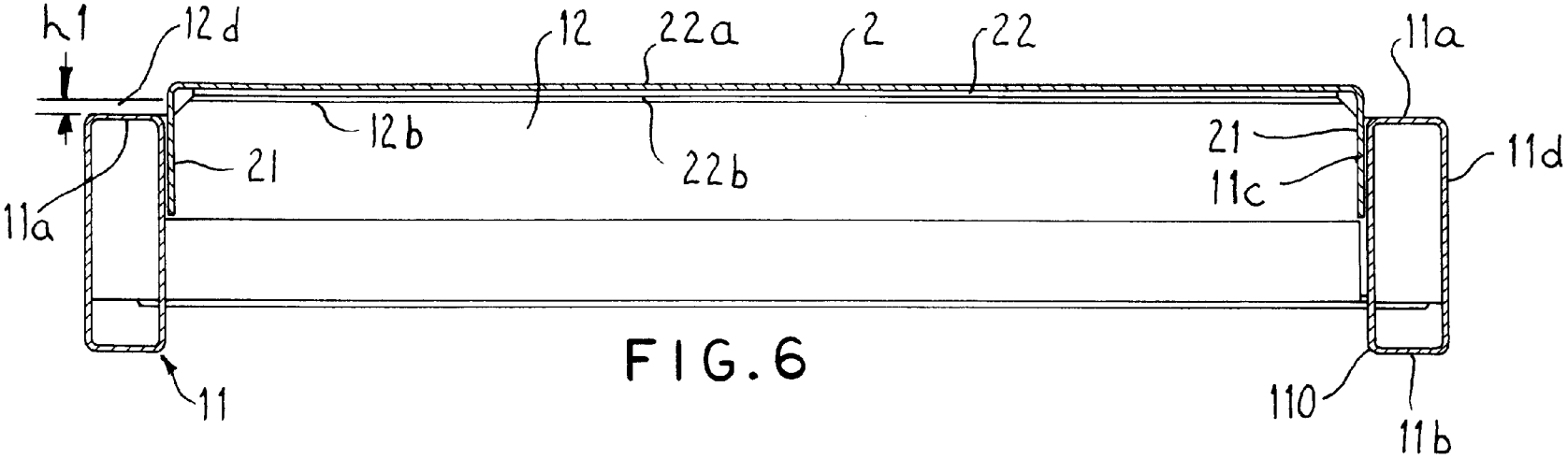
FIG. 6 is the enlarged front view of FIG. 2.

The footplate 2 is designed, in accordance with FIG. 1, as a perforated plate and is clamped between the longitudinal bearing members 11 just like the reinforcing bar 14. FIG. 3 shows resistance spot welds 4 between the bearing frame 1 and the footplate 2, with which flange plates 21 of the footplate 2, which are vertical in the position of use, are connected with a rigid substance to the longitudinal bearing members 11. These longitudinal bearing members 11 are designed each as an upright positioned rectangular, extruded hollow cross section 110, which according to FIG. 6 is composed of horizontal upper and lower flanges 11*a*, 11*b* and inner and outer crosspieces 11*c*, 11*d*.

Figure 4:
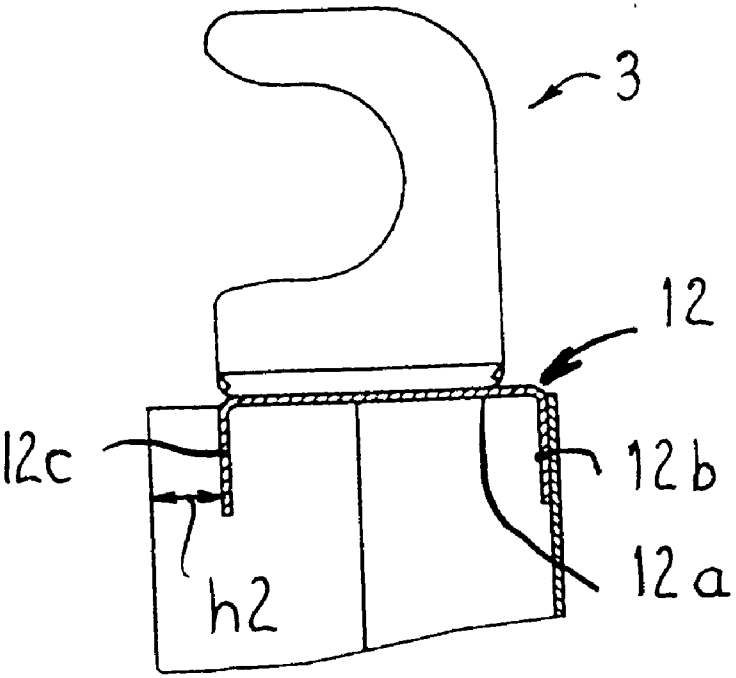
FIG. 4 shows an enlarged detail C of FIG. 3.

The profile of one of the cross-bearing members 12 and its relative position on the longitudinal bearing members 11 can be easily recognized in FIG. 4; it has a U-shape and is composed of a sectional crosspiece 12*a* and upper and lower sectional flanges 12*b*, 12*c* bent from the sectional crosspiece 12*a*. The cross-bearing member 12 is clamped between the longitudinal bearing members 11 in such a manner that its upper sectional flange 12*b* projects above the upper flange 11*a* of the longitudinal bearing member at a height $h_1$ (FIG. 6). The thus formed projecting space 12*d* in the width of the longitudinal bearing members 11 are disengaged from the crossbars 12.

Figure 8:
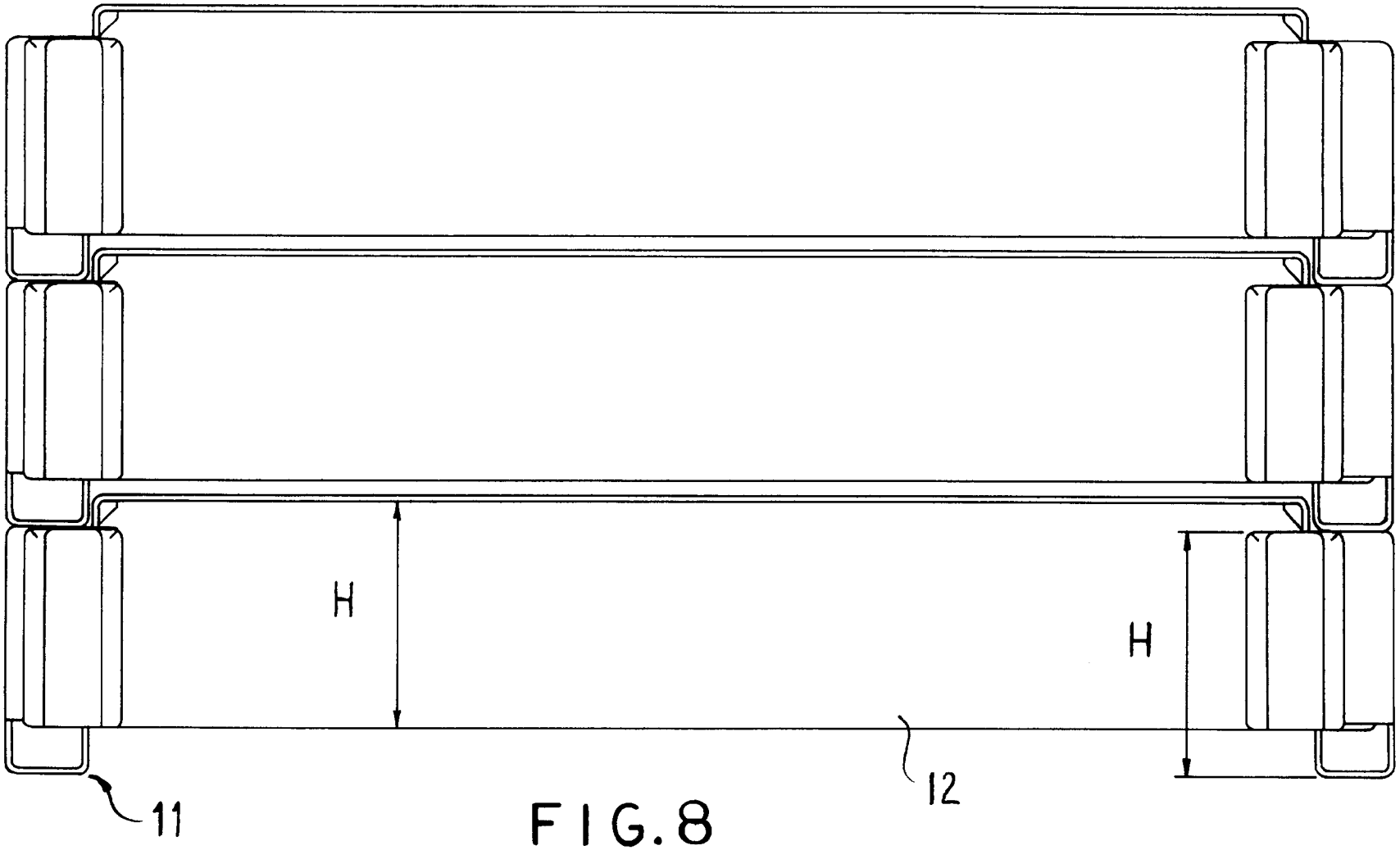
FIG. 8 shows several working platforms stacked one on top of the other corresponding to FIG. 6.

The lower sectional flanges 12*c* are, on the other hand corresponding to FIG. 4, inserted at a height $h_2$ above the lower flanges 11*b* of the longitudinal bearing members 11 into the bearing frame 1. The height $h_1$ is at most as great as the height $h_2$ so that (FIG. 8) working platforms, which are placed one on top of the other can be easily and securely stacked. If the heights $h_1$ and $h_2$ are the same, then the cross-bearing members 12 have also the bearing-frame uniform height H the same as the height of the longitudinal bearing members 11.

Figure 5:
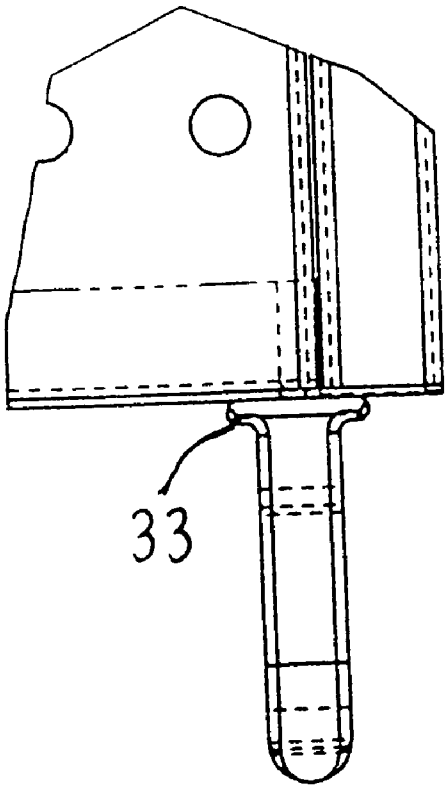
FIG. 5 shows an enlarged detail D of FIG. 1.
Figure 7:
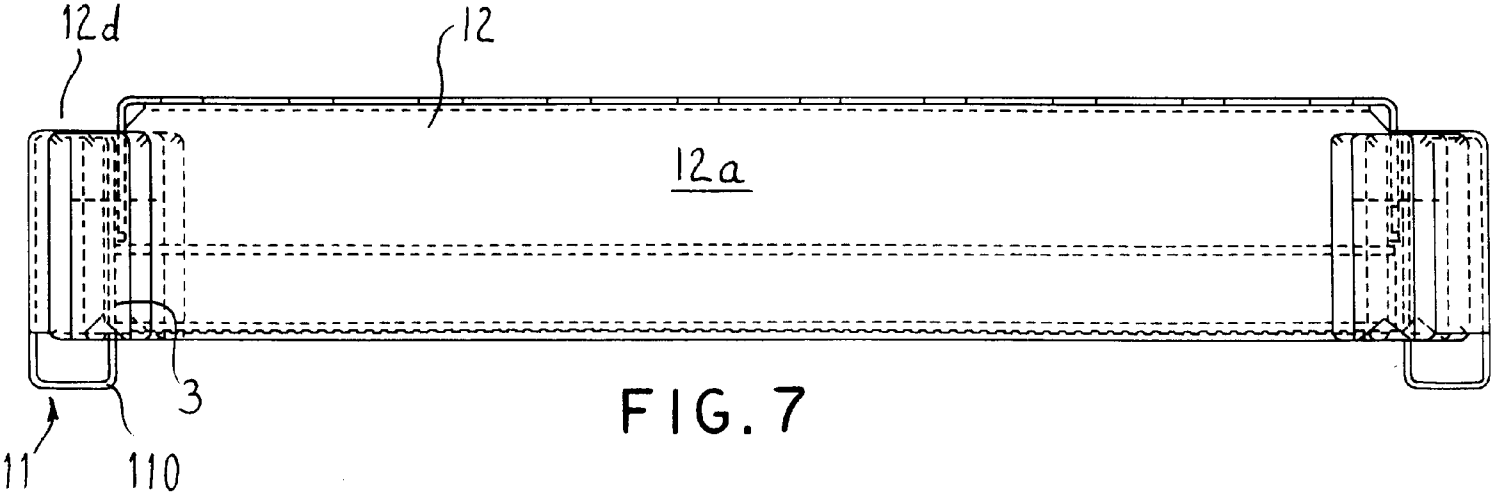
FIG. 7 is the front view of FIG. 6, however, not in cross section.

The mountings 3 are, with reference to the cross-bearing members 12, not provided mirror inverted on the bearing frame 1, but they are instead offset in pairs on its two ends 1*a* so that adjacent bearing frames 1, 1' can be placed on the same transverse spar of a scaffolding, however, their longitudinal sides 1*b* are still flush. This situation can be easily recognized in FIG. 7 because the not visible mountings 3 are also positioned on the end 1*a,* which lies behind the drawing plane. The mountings 3 are welded therearound to the sectional crosspieces 12*a* and are provided in one piece in a suitable manner with a bracket plate 33 (FIG. 5).

The footplate 2 is also designed in a U-shape (FIG. 6). A crosspiece plate 22 is thereby provided between the flange plates 21. The upper side 22*a* of the crosspiece plate, which upper side is horizontal in the position of use, forms the bearing surface 20 (FIG. 1). Its bottom side 22*b* rests on the upper sectional flanges 12*b* of the cross-bearing members 12, whereas the part of the flange plate 21 extending into the bearing frame 1 is connected to the inner crosspieces 11*c* of the longitudinal bearing members 11 adjacently resting flat thereagainst, in the easiest manner as already mentioned above, by means of resistance spot weldings 4.

A possibly provided reinforcing bar 14 is instead welded best by means of a throat seam to the longitudinal bearing member 11.

LIST OF REFERENCE NUMERALS

1 Bearing frame
1' Bearing frame, adjacent
1*a* End
1*a* End, adjacent
1*b* Longitudinal side
11 Longitudinal bearing member
110 Hollow section
11*a* (Upper) flange
11*b* (Lower) flange
11*c* (Inner) crosspiece
11*d* (Outer) crosspiece
12 Cross-bearing member
12' Cross-bearing member, adjacent
12*a* Sectional crosspiece
12*b* (Upper) sectional flange
12*c* (Lower) sectional flange
12*d* Spaces
13 Corner
14 Reinforcing bar
2 Footplate
20 Bearing surface
21 Flange plate
22 Crosspiece plate
22*a* (Upper) side
22*b* (Lower) side
3 Mounting
3' Mounting, adjacent
31 Hook
32 Hook eyelet
33 Bracket plate
4 Resistance spot weldments
$h_1$ Height of upper sectional flange, width
$h_2$ Height of lower sectional flange
H Height (longitudinal bearing and cross-bearing members)

I claim:

1. A working platform for a scaffolding, the platform being fastenable on two horizontal transverse spars of the scaffolding, comprising: at least one rectangular bearing frame composed of longitudinal bearing members and cross-bearing members, ends of the frame being formed by the cross-bearing members and being parallel with each adjacent end of further bearing frames supportable at the same height on the scaffolding, and a footplate secured on the longitudinal bearing members of the bearing frame, the footplate defining a bearing surface which is adapted to support a person, the footplate being inverted U-shaped and having an upper horizontal crosspiece plate defining the bearing surface and having vertical flange plates downwardly bent respectively on both sides of the crosspiece plate, the longitudinal bearing members each comprising a closed hollow section, which is approximately rectangular in cross section, and which comprises two parallel vertical pieces and horizontal flanges, and the flange plates being fastened onto an inner one of the vertical pieces so that the crosspiece plate is vertically offset above and parallel an upper one of the flanges, the cross-bearing members and the longitudinal bearing members having a same height dimension and the cross bearing members being offset above the longitudinal bearing members, and at least two hook-shaped mountings being provided on each of the cross-bearing members, the at least two hook-shaped mountings being adapted for receiving the transverse spars of the scaffolding therein.

2. The working platform according to claim 1, wherein the footplate is at least a partially perforated plate.

3. The working platform according to claim 1, wherein the crosspiece plate is positioned at approximately half of the height of the flange plates above an upper one of the flanges.

4. The working platform according to claim 1, wherein the flange plates are welded respectively to inner ones of the vertical pieces of the longitudinal bearing members.

5. The working platform according to claim 1, wherein the cross-bearing members are welded to the longitudinal bearing members on an end of the bearing frame, the cross-bearing members are C-shaped bent sections opening sidewardly, a vertically extending bight of the respective cross-bearing member borders the end of the bearing frame, and the flanges of the respective cross-bearing member are positioned such that the vertically extending bight covers and closes the hollow section of the respective longitudinal bearing member.

6. The working platform according to claim 5, wherein an upper one of the flanges of the cross-bearing member underpin the footplate.

7. The working platform according to claim 5, wherein a lower one of the flanges of the cross-bearing member end above the lower horizontal flanges of the longitudinal bearing members.

8. The working platform according to claim 1, wherein the mountings are arranged on the cross-bearing members of the bearing frame and are spaced from longitudinal sides of the bearing frame, the longitudinal sides being formed by the longitudinal bearing members, the mountings being offset with respect to the longitudinal bearing members on an adjacent cross-bearing member of a further bearing frame so that with the bearing frames are aligned and the mountings of each bearing frame are arranged on the same transverse spar.

9. The working platform according to claim 8, wherein the mountings are provided in pairs on the cross-bearing members and near the longitudinal bearing members.

10. The working platform according to claim 1, wherein the mountings are welded to the cross-bearing members of the bearing frame.

11. The working platform according to claim 1, wherein at least one reinforcing bar is clamped between the longitudinal bearing members on the bearing frame, the at least one reinforcing bar being parallel to the cross-bearing members.

12. The working platform according to claim 1, wherein said bearing surface is a perforated plate.

13. A scaffolding platform including two platform units each having one end mounted on a single scaffolding spar, each platform unit extending in first and second directions, the first direction being generally transverse to the second direction, each platform unit comprising:

two elongate side bearing members spaced from each other in the second direction and extending in the first direction, the side bearing members each having inner and outer vertical pieces, and upper and lower horizontal flanges, the pieces and flanges of each side bearing member enclosing a hollow interior which is open at each end, the upper horizontal flanges extending in a plane;

two elongate end bearing members respectively connected at the ends of the side bearing members and extending in the second direction joining the two side bearing members, the end bearing members each having a C-shape including horizontal upper and lower plates, and a vertical outer bight extending between the upper and lower plates, the upper plate extending vertically offset above the plane of the upper horizontal flanges;

an inverted U-shaped plate providing a person supporting surface, the plate having a horizontal crosspiece and flange members extending downwardly from the two sides of the horizontal crosspiece, the flange members being respectively secured to the inner vertical pieces of the side bearing members, the horizontal crosspiece being parallel to the plane and vertically offset above the plane; and at least two hook-shaped mountings fastened on each of the end bearing members, the hook-shaped mountings being adapted to be received on the transverse scaffolding spars to support the platform units therefrom, the hook-shaped mountings extending in the first direction, the hook-shaped mountings being respectively offset inwardly in the second direction from the ends of the side bearing members so that adjacent platforms are supported by the single scaffolding spar and have the side bearing members of the two platform units aligned.

* * * * *